United States Patent [19]

Burton, III

[11] 4,315,657

[45] Feb. 16, 1982

[54] GAS SEAL FOR AN IN SITU OIL SHALE RETORT AND METHOD OF FORMING THERMAL BARRIER

[75] Inventor: Robert S. Burton, III, Mesa, Colo.

[73] Assignee: Occidental Oil Shale, Inc., Grand Junction, Colo.

[21] Appl. No.: 131,398

[22] Filed: Mar. 17, 1980

[51] Int. Cl.[3] ..... E21C 41/10; E21D 11/10

[52] U.S. Cl. ..... 299/2; 299/19; 405/132

[58] Field of Search ..... 299/2, 12, 19; 166/256, 166/259; 169/64; 405/144, 132

[56] References Cited

U.S. PATENT DOCUMENTS

| | | | |
|---|---|---|---|
| 1,269,747 | 6/1918 | Rogers | 299/2 |
| 3,302,343 | 2/1967 | Bear | 405/132 X |
| 3,583,165 | 6/1971 | West | 405/132 |
| 4,007,963 | 2/1977 | Ridley | 299/2 |
| 4,027,917 | 6/1977 | Bartel et al. | 299/2 |
| 4,106,814 | 8/1978 | French | 299/2 |
| 4,133,580 | 1/1979 | French | 299/2 |

*Primary Examiner*—Ernest R. Purser

*Attorney, Agent, or Firm*—Christie, Parker & Hale

[57] ABSTRACT

A gas seal is provided in an access drift excavated in a subterranean formation containing oil shale. The access drift is adjacent an in situ oil shale retort and is in gas communication with the fragmented permeable mass of formation particles containing oil shale formed in the in situ oil shale retort. The mass of formation particles extends into the access drift, forming a rubble pile of formation particles having a face approximately at the angle of repose of fragmented formation.

The gas seal includes a temperature barrier which includes a layer of heat insulating material disposed on the face of the rubble pile of formation particles and additionally includes a gas barrier. The gas barrier is a gas-tight bulkhead installed across the access drift at a location in the access drift spaced apart from the temperature barrier.

30 Claims, 1 Drawing Figure

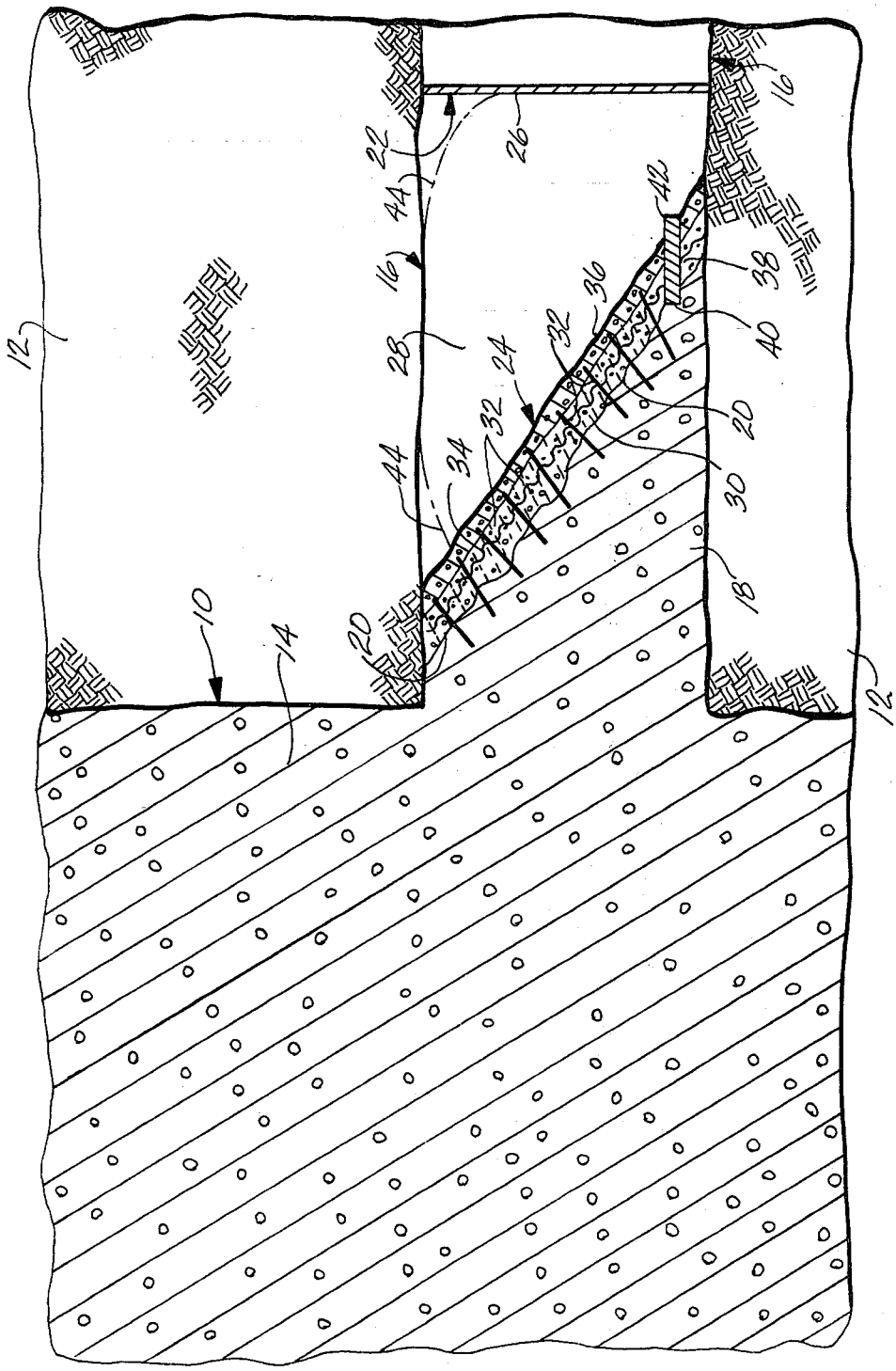
10
12
14
16
18
20
22
24
26
28
30
32
34
36
38
40
42
44

GAS SEAL FOR AN IN SITU OIL SHALE RETORT AND METHOD OF FORMING THERMAL BARRIER

The Government of the United States of America has rights in this invention pursuant to Agreement No. ET-77-A-03-1848 with the Department of Energy.

FIELD OF THE INVENTION

An access drift in gas communication with an in situ oil shale retort formed in a subterranean formation is provided with a gas seal for maintaining adjacent workings free of gases produced in the in situ oil shale retort during retorting operations.

BACKGROUND OF THE INVENTION

The presence of large deposits of oil shale in the Rocky Mountain region of the United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferable from the standpoint of environmental impact inasmuch as the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. These patents described in situ recovery of liquid and gaseous hydrocarbon materials from a subterranean formation containing oil shale, wherein such formation is fragmented to form a stationary, fragmented permeable body or mass of formation particles containing oil shale within the formation, referred to herein as an in situ oil shale retort.

Hot retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,432, includes establishing a combustion zone in the fragmented mass and introducing an oxygen-supplying gaseous combustion zone feed into the fragmented mass to advance the combustion zone through the fragmented mass. In the combustion zone, oxygen in the combustion zone feed is depleted by reaction with hot carbonaceous materials to produce heat, combustion gas, and combusted oil shale. By the continued introduction of the combustion zone feed into the fragmented mass, the combustion zone is advanced through the fragmented mass.

The combustion gas and the portion of the combustion zone feed that does not take part in the combustion process pass through the fragmented mass on the advancing side of the combustion zone. This heats the oil shale in a retorting zone to a temperature sufficient to produce kerogen decomposition, called "retorting", in the oil shale. The kerogen decomposes into gaseous and liquid products, including gaseous and liquid hydrocarbon products, and into a residual solid carbonaceous material.

The liquid hydrocarbon products, together with water produced in or added to the fragmented mass, are collected at the bottom of the fragmented mass. An off gas also is withdrawn from the bottom of the fragmented mass. The off gas contains combustion gas, including carbon dioxide generated in the combustion zone, gaseous products produced in the retorting zone, carbon dioxide from carbonate decomposition, and any gaseous combustion zone feed that does not take part in the combustion process. The products of retorting are referred to herein as liquid and gaseous products.

The off gas produced during retorting can contain carbon monoxide and sulfur compounds such as hydrogen sulfide. Hydrogen sulfide and carbon monoxide are extremely toxic gases.

Additionally, since it is generally considered that retorting of oil shale commences in a retorting zone when oil shale is heated to at least about 900° F., the combustion zone formed is substantially hotter than about 900° F. and can have a temperature of up to about 1800° F.

The gases produced are, therefore, very hot and for these reasons it is desirable to seal an access drift which is in fluid communication with the fragmented mass so that workers in adjacent underground workings are isolated from the off gas produced in the fragmented mass during the retorting operations.

U.S. Pat. Application Ser. No. 28,226, filed on April 9, 1979, by Kilburn, which is assigned to the assignee of the present invention and incorporated herein by this reference, discloses an insulated bulkhead which seals an access drift adjacent a fragmented permeable mass of formation particles in an in situ oil shale retort.

The bulkhead includes a steel plate for closing the cross-sectional area of the drift. The periphery of the bulkhead is anchored in concrete in a slot cut into the walls, roof, and floor of the drift. A layer of heat insulating material is applied to the face of the bulkhead adjacent the hot portion of the fragmented mass and a second layer of heat insulating material covers the walls, roof, and floor of the drift adjacent the insulated face of the bulkhead plate to minimize thermal degradation of formation surrounding the periphery of the bulkhead. Thermal degradation of formation surrounding a bulkhead caused by hot gases from the retort can result in spalling and sloughing of formation from the wall of the drift, thereby causing a bulkhead to lose its gas sealing capability.

It has been found that insulating a bulkhead and the formation surrounding the bulkhead is an expensive and time-consuming process.

It is, therefore, desirable to provide an improved gas seal which can be economically installed in an access drift and which can withstand high temperatures of retort gases without structural failure for at least the active life of the retort.

SUMMARY OF THE INVENTION

A means for sealing an access drift excavated in a subterranean formation containing oil shale is provided.

The access drift is adjacent an in situ oil shale retort and in gas communication with a fragmented permeable mass of formation particles containing oil shale in the in situ oil shale retort. The drift contains a rubble pile of formation particles having a face approximately at the angle of repose of fragmented formation. The seal comprises a layer of heat insulating material disposed on the face of the rubble pile of formation particles and a gas-tight bulkhead placed across such an access drift. The bulkhead has an inside surface facing toward the rubble pile of formation particles and is spaced apart from the rubble pile.

DRAWINGS

These and other aspects of the invention will be more fully understood by referring to the following detailed description and the accompanying drawing which is a fragmentary, semi-schematic, vertical cross-sectional view showing a gas seal provided according to principles of this invention for sealing an access drift in gas communication with an in situ oil shale retort.

DETAILED DESCRIPTION

Referring to the drawing, a portion of an in situ oil shale retort 10 formed in a subterranean formation 12 containing oil shale is shown in vertical cross-section.

A fragmented permeable mass of formation particles 14 is formed in the in situ oil shale retort by excavating at least one void (not shown) from within the boundaries of a retort site, leaving a remaining portion of unfragmented formation within the retort site adjacent the void.

An access drift 16 is excavated within the subterranean formation in part to provide for the excavation of formation from within the boundaries of the retort site.

Explosive is thereafter placed in the remaining portion of unfragmented formation adjacent the void and the explosive is detonated to explosively expand unfragmented formation toward a free face adjacent such a void to form the fragmented permeable mass of formation particles 14 in the in situ oil shale retort. Additionally, a portion of the formation particles formed by the explosive expansion of unfragmented formation enters the access drift 16 and forms a rubble pile 18 of formation particles. The rubble pile of formation particles has a face 20, i.e., a top surface, which is at about the angle of repose of such formation particles.

Additional details of forming an in situ oil shale retort can, for example, be found in U.S. Pat. No. 4,043,595 by French; U.S. Pat. No. 4,043,596 by Ridley; U.S. Pat. No. 4,043,597 by French; and U.S. Pat. No. 4,043,598 by French et al.

The access drift 16 remains in gas communication with the fragmented permeable mass of formation particles in the retort and, therefore, a gas seal is provided to keep hot toxic gases formed during the retorting operation from flowing into adjacent underground workings.

In an exemplary embodiment, the gas seal comprises a gas or pressure barrier in the form of a gas-tight bulkhead 22 placed across the access drift and a temperature barrier 24 placed across the face of the rubble pile of formation particles formed in the drift.

The bulkhead provides a gas or pressure barrier for inhibiting the flow of hot gases from the in situ oil shale retort to the access drift on the side of the bulkhead opposite the in situ oil shale retort.

The bulkhead 22 has an inside surface 26 facing toward the rubble pile of formation particles and is spaced apart from the rubble pile, thereby leaving a void space 28 in the access drift between the bulkhead and the rubble pile.

In an exemplary embodiment, the bulkhead is made of steel and the periphery of the bulkhead is anchored in a peripheral slot cut into the floor, roof, and side walls of formation surrounding the access drift. The access drift of the exemplary embodiment is generally rectangular in cross-section and, therefore, defines a floor, roof, and side walls which are referred to hereafter as the walls of the drift for simplicity. The peripheral slot extends entirely around the wall of the drift and the periphery of the bulkhead extends outwardly into the slot beyond the drift wall. The periphery of the bulkhead is sealed to the wall of the access drift by concrete or the like to form the gas barrier.

In an exemplary embodiment, the gas-tight bulkhead is designed to withstand a differential pressure of about plus or minus five pounds.

Other types of gas and pressure resisting bulkheads are also suitable. For example, a steel frame can be anchored in the drift with rock bolts into the walls and the edges of the frame sealed to the walls by shotcrete or the like. A steel plate welded into the frame completes the bulkhead.

The temperature barrier 24 of an exemplary embodiment provides a temperature gradient between the hot fragmented permeable mass of formation particles in the retort and the walls of the drift in the void space 28. The temperature barrier comprises a layer 30 of heat of thermal insulating material disposed on the face 20 of the rubble pile of formation particles. The layer of heat insulating material can, for example, be a castable refractory material such as the material identified as VSL-50 and sold by A. P. Green Refractories Company. Such insulating material comprises about 51% to about 54% silica, about 32% to about 35% alumina, about 9.5% to 11% calcium oxide, about 1% to 2% alkali such as sodium oxide or potassium oxide, about 0.6% to 0.9% iron oxide, about 0.1% to about 0.6% magnesia, and about 0.5% to 1.5% titanium dioxide.

The insulating material has a thermal conductivity of about 1.74 BTU/sq. ft./hr./°F./in. at a mean temperature of about 1600° F. and can be sprayed onto the face of the rubble pile if desired. The temperature resistance of the material is 2300° F., i.e., it does not melt or otherwise thermally degrade when a surface of the material is exposed to temperatures of up to about 2300° F.

It is desirable to use an insulating material which has a temperature resistance of at least about 1800° F., which is about the maximum temperature expected in the retort. The temperature of 1800° F. is considered the maximum because it is desirable to operate the retort with a safety margin below the 2100° F. fusion temperature of oil shale.

The access drift 16 is located between the top and bottom of the retort. The combustion zone formed in the fragmented permeable mass proceeds from the top of the retort downwardly to the bottom of the retort during retorting operations.

Retorts provided can have a height of hundreds of feet and a combustion zone moves through a retort at about 1 to about 2 feet per day.

Although the active life of a retort, i.e., the time during which retorting operations are underway, can be six months or more; the combustion zone is adjacent a drift for a period of only several days or perhaps a week or so. This is not sufficient time for the temperature to equalize across the temperature barrier.

In order to provide a temperature seal across the entire cross-section of the drift, it is desirable that the rubble pile of formation particles completely cover the opening leading from the fragmented permeable mass of formation particles in the in situ oil shale retort into the access drift.

It is desired that the outer perimeter of the rubble pile of formation particles contact substantially the entire perimeter of the access drift so that the temperature barrier formed across the face of the rubble pile will contact the entire perimeter of the drift. This insures that there will not be any appreciable gaps in the temperature barrier which would reduce the effectiveness of such a barrier.

If the rubble pile of formation particles does not completely cover the opening or if the face of the rubble pile is uneven or is not at about the angle of repose of formation particles, additional materials such as formation excavated from the retort or sand or gravel or the like can be added to the face of the rubble pile before the layer of heat insulating material is installed.

It can be desirable to provide a means for anchoring or securing the layer of thermal insulating material to the face of the rubble pile. Anchoring the insulating material to the face of the rubble pile improves the structural stability of the layer of material, reducing the chance of the layer cracking.

In an exemplary embodiment, a plurality of steel pins 32 is driven into the face of the rubble pile of formation particles. The outer ends of the steel pins are left protruding into the access drift. A wire mesh 34 is thereafter laid over the face of the rubble pile and at least is partly held in place by the pins. The layer of heat insulating material, i.e., the castable refractory material, is then sprayed over the pins and wire mesh across the entire surface of the rubble pile. For instance, it has been found that a layer of castable refractory material having a thickness of from about 4 to about 6 inches can be adequate to supply the necessary insulating properties. The pins and mesh provide support for the layer of heat insulating material and firmly secure the layer of material to the face of the rubble pile.

The layer of heat insulating material is fairly brittle and can, therefore, lack the desired amount of structural strength. Therefore, if desired, additional mechanical support can be provided to protect the layer of insulating material from cracking of spalling.

In an exemplary embodiment, a layer 36 of structural material such as concrete, applied as shotcrete, gunite, or the like can be sprayed or otherwise applied over the surface of the layer of thermal insulating material to provide the stuctural support required and to protect the insulating material from damage. For instance, a layer of structural material comprising shotcrete having a thickness of from about 4 to about 6 inches has been found to provide the desired amount of added mechanical support.

In an exemplary embodiment, the temperature barrier provides a temperature gradient, but is not desired to provide a pressure gradient.

Therefore, means are provided for equalizing the pressure across the temperature barrier so that the temperature barrier is not subjected to forces exerted by a differential pressure. In one example, the means provided to equalize pressure, i.e., to relieve the pressure differential, across the temperature barrier 20 is a 12-inch steel pipe 38 placed so that its inner end 40 is open to the face of the rubble pile 18 and its other end 42 extends beyond the face of the layer of structural material and into the void space 28 behind the bulkhead.

The pipe should have a sufficient size to provide for equalization of pressure, but yet not be so large as to result in significant flow of heat across the temperature barrier.

As described hereinabove, the pressure barrier, i.e., the gas-tight bulkhead 22, is anchored into the walls of the drift. It is, therefore, important that the walls of the drift surrounding the periphery of the bulkhead 22 are not thermally degraded.

It has been found that thermal degradation is enhanced when the temperature of oil shale formation is above about 300° F. Thermal degradation can result in sloughing or spalling of formation into the drift.

It, therefore, is desirable to provide a heat insulating layer comprising a sufficient thickness of material having a sufficiently low thermal conductivity to maintain a temperature of less than about 300° F. in the void space 28 formed in the access drift. By maintaining the temperature in the void space at less than about 300° F., formation which comprises the walls of the drift in the void space will have a maximum temperature of less than about 300° F.

Thermal degradation of the walls of the drift located in the void space will, therefore, be prevented, which can substantially reduce or even eliminate spalling or sloughing of formation from the walls. It is particularly important that formation does not slough from around the periphery of the bulkhead, which would cause the bulkhead to fail, thereby allowing gas to pass from the retort into adjacent workings.

By substantially reducing or eliminating thermal degradation of the walls of the drift in the void space, the gas-tight bulkhead remains in place across the access drift for at least the active life of a retort and in the exemplary embodiment can, therefore, withstand a five pound differential pressure for which is is designed during the active life of the retort.

If desired, an inert material 44, such as sand or gravel or the like shown in phantom lines, can be placed into the void space between the gas-tight bulkhead and the temperature barrier for preventing the accumulation of an explosive mixture of gases within the void space. Such inert material augments thermal protection of the bulkhead and can help minimize sloughing.

For example, the inert material can be blown into the void space through an opening formed in the bulkhead which is sealed before retorting operations are commenced.

The above description of a means for sealing an access drift in gas communication with a fragmented permeable mass of formation particles in an in situ oil shale retort is for illustrative purposes. Because of variations which will be apparent to those skilled in the art, the present invention is not intended to be limited to the particular embodiments described above. The scope of the invention is defined in the following claims.

What is claimed is:

1. A means for sealing an access drift excavated in a subterranean formation containing oil shale, the access drift being adjacent an in situ oil shale retort and in gas communication with a fragmented permeable mass of formation particles containing oil shale in the in situ oil shale retort, the drift containing a rubble pile of formation particles having a face approximately at the angle of repose of fragmented formation, the means comprising:

(a) a layer of heat insulating material disposed on the face of the rubble pile of formation particles; and (b) a gas-tight bulkhead placed across such an access drift, said gas-tight bulkhead spaced apart from the rubble pile forming a void space in the access drift between the gas-tight bulkhead and the layer of heat insulating material.

2. A means for providing a gas seal according to claim 1 additionally comprising a layer of structural material disposed across the surface of the layer of heat insulating material.

3. A means for providing a gas seal according to claim 1 additionally comprising means for securing the layer of heat insulating material to the face of the rubble pile of formation particles connected to the rubble pile.

4. A means for providing a gas seal according to claim 3 wherein the means for securing the layer of heat insulating material to the face of the rubble pile of formation particles comprises a plurality of steel pins driven into the face of the rubble pile of formation particles and a wire mesh disposed across the face of the rubble pile at least partly held in place by said steel pins.

5. A means for providing a gas seal according to claim 1 additionally comprising a pipe having one end open to the face of the rubble pile of formation particles and the other end extending into the void space in the access drift between the gas-tight bulkhead and the layer of heat insulating material for minimizing pressure gradient across the layer of heat insulating material.

6. A means for providing a gas and temperature seal according to claim 1 wherein the layer of heat insulating material extends completely across the face of the rubble pile of formation particles and contacts substantially the entire perimeter of such an access drift.

7. A means for providing a gas and temperature seal according to claim 1 wherein the heat insulating layer comprises a sufficient thickness of material having a sufficiently low thermal conductivity for maintaining a temperature of less than about 300° F. in the void space formed in the access drift between the gas-tight bulkhead and the layer of heat insulating material for at least the active life of the retort.

8. A means for providing a gas and temperature seal according to claim 1 wherein the layer of heat insulating material is capable of withstanding temperatures of at least about 1800° F. for at least the active life of the retort.

9. A means for providing a gas and temperature seal according to claim 1 wherein the layer of heat insulating material comprises a castable refractory thermal insulating material.

10. A means for providing a gas and temperature seal according to claim 1 wherein the layer of heat insulating material comprises a sufficient thickness of material having a sufficiently low thermal conductivity to provide a temperature gradient across such a layer of heat insulating material for maintaining formation which comprises the wall of the drift in the void space between the gas-tight bulkhead and the layer of heat insulating material at a maximum temperature of less than about 300° F.

11. A means for providing a gas and temperature seal according to claim 1 wherein the layer of heat insulating material comprises a sufficient thickness of material having a sufficiently low thermal conductivity to prevent thermal degradation of formation comprising the wall of the drift in the void space between the gas-tight bulkhead and the layer of heat insulating material.

12. A means for providing a gas and temperature seal according to claim 1 additionally comprising an inert material substantially filling the void space between the gas-tight bulkhead and the layer of heat insulating material for preventing accumulation of an explosive mixture of gases within said void space.

13. A method for forming a gas and temperature barrier in an access drift excavated in a subterranean formation containing oil shale, the access drift being adjacent an in situ oil shale retort and in gas communication with such an in situ oil shale retort comprising the steps of:

(a) forming a rubble pile of formation particles in said access drift having a face approximately at the angle of repose of fragmented formation;

(b) applying a layer of heat insulating material to the face of the rubble pile of formation particles in said access drift; and (c) installing a gas impermeable bulkhead across the access drift having an inside surface facing toward the face of the rubble pile of formation particles in the access drift, the gas impermeable bulkhead spaced apart from the face of the rubble pile of formation particles, thereby leaving a void space in the access drift between the gas impermeable bulkhead and the surface of the layer of heat insulating material.

14. The method according to claim 13 comprising the additional step of disposing a layer of structural material onto the surface of the layer of heat insulating material.

15. The method according to claim 14 comprising disposing a layer of concrete onto the surface of the layer of heat insulating material.

16. The method according to claim 13 comprising applying a layer of heat insulating material across the entire face of the rubble pile of formation particles, the periphery of the said layer of heat insulating material contacting substantially the entire perimeter of the access drift.

17. The method according to claim 13 comprising applying a layer of heat insulating material having a sufficient thickness of material having a sufficiently low thermal conductivity for maintaining the temperature in the void space in the access drift between the gas impermeable bulkhead and the surface of the layer of heat insulating material at less than about 300° F. for at least the active life of the retort.

18. The method according to claim 13 comprising applying a layer of heat insulating material capable of withstanding temperatures of up to about 1800° F. during at least the active life of the in situ oil shale retort.

19. The method according to claim 13 comprising applying a layer of heat insulating material comprising a castable refractory thermal insulating material.

20. The method according to claim 13 comprising the additional steps of:

(a) anchoring a plurality of steel pins in the face of the rubble pile of formation particles;

(b) disposing a mesh over such steel pins and onto the face of the rubble pile of formation particles; and (c) applying a layer of heat insulating material to the face of the rubble pile of formation particles over the steel pins and over the mesh, the steel pins and mesh providing support for the layer of heat insulating material.

21. The method according to claim 13 comprising applying a layer of heat insulating material having a sufficient thickness of material having a sufficiently low thermal conductivity for providing a temperature gradient across such a layer of heat insulating material such that the maximum temperature of formation defining walls of the void space between the gas impermeable bulkhead and the surface of the layer of heat insulating material remains at less than about 300° F. for at least the active life of the retort.

22. The method according to claim 13 comprising applying a layer of heat insulating material having a sufficient thickness of material having a sufficiently low thermal conductivity for preventing thermal degradation of formation defining walls of the void space between the gas impermeable bulkhead and the layer of heat insulating material.

23. The method according to claim 13 comprising the additional step of substantially filling the void space between the bulkhead and the layer of heat insulating material with an inert material for preventing an accumulation of an explosive mixture of gas in such a void space during retorting operations.

24. The method according to claim 13 comprising the additional step of relieving pressure differential across the layer of heat insulating material.

25. A subterranean formation containing oil shale comprising:

(a) an in situ oil shale retort containing a fragmented permeable mass of formation particles containing oil shale formed in the subterranean formation;

(b) an access drift formed in the subterranean formation in gas communication with the in situ oil shale retort containing a rubble pile of formation particles extending across the cross-section of such an access drift and having a face approximately at the angle of repose of fragmented formation;

(c) a layer of heat insulating material disposed on the face of the rubble pile;

(d) a layer of structural material disposed on the surface of the layer of heat insulating material; and (e) a gas-tight bulkhead placed across the access drift at a location in said access drift spaced apart from such a layer of structural material for maintaining a region of the access drift on the side of the bulkhead facing away from the rubble pile free of gases formed during retorting operations.

26. The subterranean formation as claimed in claim 25 additionally comprising a means for relieving pressure differential across the layer of heat insulating material.

27. A method for thermally protecting a gas-tight bulkhead in an access drift adjacent an in situ oil shale retort containing a fragmented permeable mass of formation particles containing oil shale through which a combustion zone is advanced, comprising the step of:

(a) applying a sufficient layer of thermal insulating material on the face of a rubble pile of formation particles in the drift for maintaining the temperature of the walls of the drift in a void space between the layer of insulating material and the bulkhead below the temperature of thermal sloughing of such walls.

28. The method according to claim 27 comprising the additional step of disposing a layer of structural material onto the surface of the layer of thermal insulating material.

29. The method according to claim 27 comprising disposing a layer of concrete onto the surface of the layer of thermal insulating material.

30. The method according to claim 27 comprising applying a layer of thermal insulating material comprising a castable refractory thermal insulating material on the face of the rubble pile of formation particles.

* * * * *